US009695494B2

(12) United States Patent
Schroers et al.

(10) Patent No.: US 9,695,494 B2
(45) **Date of Patent: *Jul. 4, 2017**

(54) AU-BASE BULK SOLIDIFYING AMORPHOUS ALLOYS

(71) Applicant: Crucible Intellectual Property, LLC, Rancho Santa Margarita, CA (US)

(72) Inventors: Jan Schroers, Laguna Beach, CA (US); Atakan Peker, Aliso Viejo, CA (US)

(73) Assignee: Crucible Intellectual Property, LLC, Rancho Santa Margarita, CA (US)

( * ) Notice: Subject to any disclaimer, the term of this patent is extended or adjusted under 35 U.S.C. 154(b) by 18 days.

This patent is subject to a terminal disclaimer.

(21) Appl. No.: 13/945,176

(22) Filed: Jul. 18, 2013

(65) Prior Publication Data

US 2013/0299048 A1 Nov. 14, 2013
US 2017/0152586 A9 Jun. 1, 2017

Related U.S. Application Data

(62) Division of application No. 11/576,922, filed as application No. PCT/US2005/038171 on Oct. 17, 2005, now Pat. No. 8,501,087.

(60) Provisional application No. 60/619,363, filed on Oct. 15, 2004.

(51) Int. Cl.
*C22C 45/00* (2006.01)

(52) U.S. Cl.
CPC ..... *C22C 45/003* (2013.01); *C22C 45/001* (2013.01); *Y10T 428/12* (2015.01)

(58) Field of Classification Search
None
See application file for complete search history.

(56) References Cited

U.S. PATENT DOCUMENTS 2,190,611 A 2/1940 Sembdner
3,856,651 A * 12/1974 Raetzsch ..... C25B 9/206 204/255
3,989,517 A 11/1976 Tanner et al.
4,050,931 A 9/1977 Tanner et al.
4,064,757 A 12/1977 Hasegawa
4,067,732 A 1/1978 Ray
4,113,478 A 9/1978 Tanner et al.
4,115,682 A 9/1978 Kavesh et al.
4,116,682 A 9/1978 Polk et al.
4,116,687 A 9/1978 Hasegawa
4,135,924 A 1/1979 Tanner et al.
4,148,669 A 4/1979 Tanner et al.
4,289,009 A 9/1981 Festag et al.
4,472,955 A 9/1984 Nakamura et al.
4,621,031 A 11/1986 Scruggs
4,623,387 A 11/1986 Masumoto et al.
4,648,609 A 3/1987 Deike
4,710,235 A 12/1987 Scruggs
4,721,154 A 1/1988 Christ et al.
4,728,580 A 3/1988 Grasselli et al.
4,743,513 A 5/1988 Scruggs
4,781,803 A 11/1988 Harris et al.
4,854,370 A 8/1989 Nakamura
4,976,417 A 12/1990 Smith
4,987,033 A 1/1991 Abkowitz et al.
4,990,198 A 2/1991 Masumoto et al.
5,032,196 A 7/1991 Masumoto et al.
5,053,084 A 10/1991 Masumoto et al.
5,053,085 A 10/1991 Masumoto et al.
5,074,935 A 12/1991 Masumoto et al.
5,117,894 A 6/1992 Katahira
5,131,279 A 7/1992 Lang et al.
5,169,282 A 12/1992 Ueda et al.
5,213,148 A 5/1993 Masumoto et al.
5,225,004 A 7/1993 O'Handley et al.
5,250,124 A 10/1993 Yamaguchi et al.
5,279,349 A 1/1994 Horimura
5,288,344 A * 2/1994 Peker et al. ..... 148/403
5,296,059 A 3/1994 Masumoto et al.
5,306,463 A 4/1994 Horimura
5,312,495 A 5/1994 Masumoto et al.
5,324,368 A 6/1994 Masumoto et al.
5,368,659 A 11/1994 Peker et al.
5,380,375 A 1/1995 Hashimoto et al.
5,384,203 A 1/1995 Apfel (Continued)

FOREIGN PATENT DOCUMENTS

GB 2236325 4/1991
JP 55141537 11/1980

(Continued)

OTHER PUBLICATIONS

JP 55141537, Nishikawa, English Translation.*
Supplemental European Search Report mailed Nov. 20, 2007, for EP 05815431.
UES, Inc. Software Products Center, "ProCAST . . . not just for castings!", Sep. 30, 1996, 1 pg.
American Society for Metals, "Forging and Casting", Metals Handbook, Jan. 1970, vol. 5, 8th Edition, 16 pgs.
Hasegawa et al., "Superconducting Properties of Be—Zr Glassy Alloys Obtained by Liquid Quenching", May 9, 1977, pp. 3925-3928.

(Continued)

*Primary Examiner* — Colin W Slifka

(74) *Attorney, Agent, or Firm* — Brownstein Hyatt Farber Schreck, LLP

(57) ABSTRACT

Compositions for forming Au-based bulk-solidifying amorphous alloys are provided. The Au-based bulk-solidifying amorphous alloys of the current invention are based on ternary Au—Cu—Si alloys, and the extension of this ternary system to higher order alloys by the addition of one or more alloying elements. Additional substitute elements are also provided, which allow for the tailoring of the physical properties of the Au-base bulk-solidifying amorphous alloys of the current invention.

19 Claims, No Drawings

(56) References Cited

U.S. PATENT DOCUMENTS

| | | | |
|---|---|---|---|
| 5,390,724 | A | 2/1995 | Yamaguchi et al. |
| 5,449,425 | A | 9/1995 | Renard et al. |
| 5,482,580 | A | 1/1996 | Scruggs et al. |
| 5,567,251 | A | 10/1996 | Peker et al. |
| 5,589,012 | A | 12/1996 | Hobby et al. |
| 5,593,514 | A | 1/1997 | Glessen et al. |
| 5,711,363 | A | 1/1998 | Scruggs et al. |
| 5,797,443 | A | 8/1998 | Lin et al. |
| 5,886,254 | A | 3/1999 | Chi |
| 5,950,704 | A | 9/1999 | Johnson et al. |
| 6,021,840 | A | 2/2000 | Colvin |
| 6,027,586 | A | 2/2000 | Masumoto et al. |
| 6,044,893 | A | 4/2000 | Taniguchi et al. |
| 6,200,685 | B1 | 3/2001 | Davidson |
| 6,258,183 | B1 | 7/2001 | Onuki et al. |
| 6,306,228 | B1 | 10/2001 | Inoue et al. |
| 6,371,195 | B1 | 4/2002 | Onuki et al. |
| 6,376,091 | B1 | 4/2002 | Croopnick |
| 6,408,734 | B1 | 6/2002 | Cohen |
| 6,446,558 | B1 | 9/2002 | Peker et al. |
| 6,623,566 | B1 | 9/2003 | Senkov et al. |
| 8,501,087 | B2 | 8/2013 | Schroers et al. |
| 2001/0052406 | A1 | 12/2001 | Kubota et al. |
| 2002/0036034 | A1 | 3/2002 | Xing et al. |
| 2002/0050310 | A1 | 5/2002 | Kundig et al. |
| 2004/0089850 | A1 | 5/2004 | Hitoshi et al. |
| 2004/0154702 | A1 | 8/2004 | Susumu et al. |
| 2006/0037361 | A1 | 2/2006 | Johnson et al. |

FOREIGN PATENT DOCUMENTS

| | | |
|---|---|---|
| JP | 61238423 | 10/1986 |
| JP | 03013535 | 1/1991 |
| JP | 06264200 | 9/1994 |
| JP | 2000256811 | 9/2000 |

OTHER PUBLICATIONS

Inoue et al., "Bulky La-A1-TM (TM=Transition Metal) Amorphous Alloys with High Tensile Strength Produced by a High-Pressure Die Casting Method", Materials Transactions, JIM, vol. 34, No. 4, 1993, pp. 351-358.

Inoue et al., "Mg—Cu—Y Bulk Amorphous Alloys with High Tensile Strength Produced by High-Pressure Die Casting Method", Materials Transactions, JIM, 1992, vol. 33, No. 10, pp. 937-945.

Inoue et al., "Zr-A1-Ni Amorphous Alloys with High Glass Transition Temperature and Significant Supervooled Liquid Region", Materials Transactions, JIM, 1990, vol. 31, No. 3 pp. 177-183.

Jost et al., "The Structure of Amorphous Be—Ti—Zr Alloys", Zeitschrift fur Physikalische Chemie Neue Folge, Bd. 175, 1988, pp. 11-15.

Kato et al., "Production of Bulk Amorphous Mg85Y10Cu5 Alloy by Extrusion of Atomized Amorphous Powder", Materials Transactions, JIM, vol. 35, No. 2, 1994, pp. 125-129.

Kawamura et al., "Full Strength Compacts by Extrusion of Glassy Metal Powder at the Supercooled Liquid State", American Institute of Physics, May 30, 1995, vol. 67, No. 14, pp. 2008-2010.

Maret et al., "Structural Study of Be43HfxZr57-x Metallic Glasses by X-Ray and Neutron Diffraction", J. Physique, 1986, vol. 47, pp. 863-871.

Polk et al., "The Effect of Oygen Additions on the Properties of Amorphous Transition Metal Alloys", source and date unknown, pp. 220-230.

Tanner et al., "Metallic Glass Formation and Properties in Zr and Ti Alloyed with Be-1 the Binary Zr—Be and Ti—Be Systems", Acta Metallurgica, 1979, vol. 27, pp. 1727-1747.

Tanner et al., "Physical Properties of Ti50Be40Zr10 Glass", Scripta Metallurgica, 1977, vol. 11, pp. 783-789.

Tanner, L.C., "The Stable and Metastable Phase Relations in the Hf—Be Alloy System", Metallurgica, vol. 28, 1980, pp. 1805-1815.

Tanner, L.E., "Physical Properties of Ti—Be—Si Glass Ribbons", Scripta Metallurgica, 1978, vol. 12, pp. 703-708.

Warren M. Rohsenow, "Heat Transfer", Handbook of Engineering, 1936, Section 12, pp. 1113-1119.

Zhang et al., "Amorphous Zr-A1-TM (TM=Co, Ni, Cu) Alloys with Significant Supercooled Liquid Region of over 100K", Materials Transactions, JIM, 1991, vol. 32, No. 11, pp. 1005-1010.

U.S. Appl. No. 11/576,922, filed Nov. 1, 2007, Schroers et al.

* cited by examiner

AU-BASE BULK SOLIDIFYING AMORPHOUS ALLOYS

CROSS-REFERENCE TO RELATED APPLICATIONS

This application is a divisional of U.S. patent application Ser. No. 11/576,922, filed Nov. 6, 2007, now U.S. Pat. No. 8,501,087, which is a 35 U.S.C. §371 application of PCT/US2005/038171, filed Oct. 17, 2005, both of which are incorporated by reference as if fully disclosed herein.

FIELD OF THE INVENTION

The present invention is directed generally to novel bulk solidifying amorphous alloy compositions, and more specifically to Au-based bulk solidifying amorphous alloy compositions.

BACKGROUND OF THE INVENTION

Amorphous alloys (or metallic glasses) have been generally been prepared by rapid quenching from above the melt temperatures to ambient temperatures. Generally, cooling rates of $10^{5}$° C./sec have been employed to achieve an amorphous structure. However, at such high cooling rates, the heat can not be extracted from thick sections, and, as such, the thickness of articles made from amorphous alloys has been limited to tens of micrometers in at least in one dimension. This limiting dimension is generally referred to as the critical casting thickness, and can be related by heat-flow calculations to the cooling rate (or critical cooling rate) required to form an amorphous phase.

This critical thickness (or critical cooling rate) can also be used as a measure of the processability of an amorphous alloy. Until the early nineties, the processability of amorphous alloys was quite limited, and amorphous alloys were readily available only in powder form or in very thin foils or strips with critical dimensions of less than 100 micrometers. However, in the early nineties, a new class of amorphous alloys was developed that was based mostly on Zr and Ti alloy systems. It was observed that these families of alloys have much lower critical cooling rates of less than $10^{3}$° C./sec, and in some cases as low as 10° C./sec. Accordingly, it was possible to form articles having much larger critical casting thicknesses of from about 1.0 mm to as large as about 20 mm. As such, these alloys are readily cast and shaped into three-dimensional objects, and are generally referred to as bulk-solidifying amorphous alloys.

Another measure of processability for amorphous alloys can be described by defining a ΔTsc (super-cooled liquid region), which is a relative measure of the stability of the viscous liquid regime of the alloy above the glass transition. ΔTsc is defined as the difference between Tx, the onset temperature of crystallization, and Tsc, the onset temperature of super-cooled liquid region. These values can be conveniently determined by using standard calorimetric techniques such as DSC measurements at 20° C./min. For the purposes of this disclosure, Tg, Tsc and Tx are determined from standard DSC (Differential Scanning Calorimetry) scans at 20° C./min. Tg is defined as the onset temperature of glass transition, Tsc is defined as the onset temperature of super-cooled liquid region, and Tx is defined as the onset temperature of crystallization. Other heating rates such as 40° C./min, or 10° C./min can also be utilized while the basic physics of this technique are still valid. All the temperature units are in ° C. Generally, a larger ΔTsc is associated with a lower critical cooling rate, though a significant amount of scatter exists at ΔTsc values of more than 40° C. Bulk-solidifying amorphous alloys with a ΔTsc of more than 40° C., and preferably more than 50° C., and still more preferably a ΔTsc of 70° C. and more are very desirable because of the relative ease of fabrication.

Another measure of processability is the effect of various factors on the critical cooling rate. For example, the level of impurities in the alloy. The tolerance of chemical impurities, such as oxygen, can have a major impact on the critical cooling rate, and, in turn, the ready production of bulk-solidifying amorphous alloys. Amorphous alloys with less sensitivity to such factors are preferred as having higher processability.

Although a number of different bulk-solidifying amorphous alloy formulations have been disclosed based on these principals, none of these formulations have been based on Au. Accordingly, a need exists to develop Au-based bulk solidifying amorphous alloys capable of use as precious metals.

SUMMARY OF THE INVENTION

The present invention is directed to Au-based bulk-solidifying amorphous alloys.

In one exemplary embodiment, the Au-based alloys have a minimum Au content of more than 75% by weight.

In one exemplary embodiment, the Au-based alloys are based on ternary Au—Cu—Si alloys.

In another exemplary embodiment, the Au—Cu—Si ternary system is extended to higher alloys by adding one or more alloying elements.

DESCRIPTION OF THE INVENTION

The present invention is directed to Au-based amorphous alloys (metallic glasses) and particularly bulk-solidifying amorphous alloys (bulk metallic glasses), which are referred to as Au-based alloys herein.

The term "amorphous or bulk-solidifying amorphous" as used herein in reference to the amorphous metal alloy means that the metal alloys are at least fifty percent amorphous by volume. Preferably the metal alloy is at least ninety-five percent amorphous, and most preferably about one hundred percent amorphous by volume.

The Au-based alloys of the current invention are based on ternary Au-based alloys and the extension of this ternary system to higher order alloys by the addition of one or more alloying elements. Although additional components may be added to the Au-based alloys of this invention, the basic components of the Au-base alloy system are Au, Cu, and Si.

Within these ternary alloys the gold content can be varied to obtain 14 karat, 18 karat, and 20 karat gold alloys, the typical Au content in common use of jewelry applications. In one preferred embodiment of the invention, the Au-based alloys have a minimum of Au content more than 75% by weight.

Although a number of different Au—Cu—Si combinations may be utilized in the Au-based alloys of the current invention, to increase the ease of casting such alloys into larger bulk objects, and for increased processability, the Au-based alloys comprise a mid-range of Au content from about 25 to about 75 atomic percentage, a mid range of Cu content from about 13 to about 45 atomic percentage, and a mid range of Si content from about 12 to about 30 atomic percent are preferred. Accordingly, in one embodiment of the invention, the Au-based alloys of the current invention comprise Au in the range of from about 30 to about 67 atomic percentage; Cu in the range of from about 19 to about 40 atomic percentage; and Si in the range of from about 14 to about 24 atomic percentage. Still more preferable is a Au-based alloy comprising a Au content from about 40 to about 60 atomic percent, a Cu content from about 24 to about 36 atomic percentage, and a Si content in the range of from about 16 to about 22 atomic percentage. (All the following composition values and ratios use atomic percentage unless otherwise stated.)

As discussed above, other elements can be added as alloying elements to improve the ease of casting the Au-based alloys of the invention into larger bulk amorphous objects, to increase the processability of the alloys, or to improve its mechanical properties and to influence its appearance. They can be divided into three groups. One is the partial substitution of Au, another group for Cu and then still another group is for partial substitution of Si. In such an embodiment, Ag is a highly preferred additional alloying element. Applicants have found that adding Ag to the Au-based alloys of the current invention improve the ease of casting the alloys into larger bulk objects and also increase the supercooled liquid region of the alloys. When Ag is added, it should be added at the expense of Au, where the Ag to Au ratio can be up to 0.3 and a preferable range of Ag to Au ratio is in the range of from about 0.05 to about 0.2. Ag also increases the glass transition temperature and thereby the ease of forming the alloy into larger bulk objects.

Another highly preferred additive alloying element is Pd. When Pd is added, it should be added at the expense of Au, where the Pd to Au ratio can be up to 0.3. A preferable range of Pd to Au ratio is in the range of from about 0.05 to about 0.2. Pd also increases the glass transition temperature and thereby the ease of forming the alloy into larger bulk objects. Pd is also used to increase the thermal stability of the alloy, and thereby increases the ability to hot form the alloy in the supercooled liquid region. Pt has a similar effect on processibility and properties of the Au-based alloy, and should be added in a similar way as above discussed for Pd. In addition, any combination of the two elements is also part of the current invention.

Ni is another preferred additive alloying element for improving the processability of the Au-based alloys of the current invention. Ni should be treated as a substitute for Cu, and when added it should be done at the expense of Cu. The ratio of Ni to Cu can be as high as 0.3. A preferred range for the ratio of Ni to Cu ratio is in the range of from about 0.05 to about 0.02. Co, Fe and Mn and Cr have similar effects on the processibility and properties of the Au-based alloy, and should be added in a similar way as discussed above for Ni. Any combination of the elements is also part of the current invention.

P is another preferred additive alloying element for improved the processability of the Au-based alloys of the current invention. P addition should be done at the expense of Si, where the P to Si ratio can be up to about 1.0. Preferably, the P to Si ratio is less than about 0.6 and even more preferable the P to Si ratio is less than 0.3.

Be is yet another additive alloying element for improving the processability, and for increasing the thermal stability of the Au-based alloys of the current invention in the viscous liquid regime above the glass transition. Be should be treated as similar to Si, and when added it should be done at the expense of Si and/or P, where the ratio of Be to the sum of Si and P ratio can be up to about 1.0. Preferably, the ratio of Be to the sum of Si and P is less than about 0.5.

It should be understood that the addition of the above mentioned additive alloying elements may have a varying degree of effectiveness for improving the processability in the spectrum of alloy composition range described above and below, and that this should not be taken as a limitation of the current invention. It should also be understood that the addition of additives even though individually discussed are in some cases most effective when combined in select combinations. For example, the Au-alloy containing Au—Cu—Ag—Pd—Si—Be has a high hardness, but Au—Cu—Pd—Si—Be has a larger thermal stability. Therefore, the current invention also comprises the combination of the discussed alloy additives.

The Ag, Pd, Ni, P and Be additive alloying elements can also improve certain physical properties such as hardness, yield strength and glass transition temperature. A higher content of these elements in the Au-based alloys of the current invention is preferred for alloys having higher hardness, higher yield strength, and higher glass transition temperature.

Other alloying elements that may be used to replace Si or the other replacement elements for Si are Ge, Al, Sn, Sb, Y, Er. The ratio of Si to replacement elements can improve processability and also the cosmetics and color of those alloys. These elements can be used as a fractional replacement of Si or elements that replace Si. When added it should be done at the expense of Si or the Si replacements where the ratio of any combination of Ge, Al, Sn, Sb, Y, Er to Si can be up to about 1.0. Preferably, the ratio is less than about 0.5.

Another group of alloy additions may be added only in small quantities where any combination of this group will not exceed 3%. It can be as little as 0.02%. These elements are Zr, Hf, Er, Y (here as a replacement for Au and Cu), Sc, and Ti. These additions improve the ease of forming amorphous phase by reducing the detrimental effects of incidental impurities in the alloy.

Additions in small quantities, typically less than 2% that influence the color of the alloy are also included in the current invention. Alloy additions are limited to elements that do not limit the critical casting thickness of the alloy to less than 1 mm.

Other alloying elements can also be added, generally without any significant effect on processability when their total amount is limited to less than 2%. However, a higher amount of other elements can cause the degrading of processability, especially when compared to the processability of the exemplary alloy compositions described below. In limited and specific cases, the addition of other alloying elements may improve the processability of alloy compositions with marginal critical casting thicknesses of less than 1.0 mm. It should be understood that such alloy compositions are also included in the current invention.

Given the above discussion, in general, the Au-base alloys of the current invention can be expressed by the following general formula (where a, b, c are in atomic percentages and x, y, z, v, and w are in fractions of whole):

$$(Au_{1-x}(Ag_{1-y}(Pd, Pt)_y)_x)_a(Cu_{1-z}(Ni, Co, Fe, Cr, Mn)_z)_b((Si_{1-v}P_v)_{1-w}(Ge, Al, Y, Be)_w)_c$$

where a is in the range of from about 25 to about 75, b is in the range of about 10 to about 50, c is in the range of about 12 to about 30 in atomic percentages. The following constraints are given for the x, y, z, v, and w fraction:

x is between 0 and 0.5
y is between 0 and 1
z is between 0 and 0.5
v is between 0 and 0.5
w is between 0 and 1.

Preferably, the Au-based alloys of the current invention are given by the formula:

$$(Au_{1-x}(Ag_{1-y}(Pd, Pt)_y)_x)_a(Cu_{1-z}(Ni, Co, Fe, Cr, Mn)_z)_b((Si_{1-v}P_v)_{1-w}(Ge, Al, Y, Be)_w)_c$$

where a is in the range of from about 29 to about 70, b in the range of about 15 to about 45, and c is in the range of about 12 to about 30 in atomic percentages. The following constraints are given for the x, y, z, v and w fraction:

x is between 0.0 and 0.3
y is between 0 and 0.9
z is between 0 and 0.3
v between 0 and 0.5
w between 0 and 1.

Still more preferable the Au-based alloys of the current invention are given by the formula:

$$(Au_{1-x}(Ag_{1-y}(Pd, Pt)_y)_x)_a(Cu_{1-z}(Ni, Co, Fe, Cr, Mn)_z)_b((Si_{1-v}P_v)_{1-w}(Ge, Al, Y, Be)_w)_c$$

a is in the range of from about 31 to about 64, b is in the range of about 22 to about 36, and c is in the range of from about 12 to about 26 atomic percentages. The following constraints are given for the x, y, z, v and w fraction:

x is between 0.05 and 0.15
y is between 0 and 0.8
z is between 0 and 0.1
v is between 0 and 0.5
w is between 0 and 1.

For increased processability, the above mentioned alloys are preferably selected to have four or more elemental components. The most preferred combination of components for Au-based quaternary alloys of the current invention are: Au, Cu, Ag and Si; Au, Cu, Si and P; Au, Cu, Pd and Si; and Au, Cu, Si, and Be.

The most preferred combinations for five component Au-based alloys of the current invention are: Au, Cu, Pd, Ag and Si; Au, Cu, Ag, Si and P; Au, Cu, Pd, Si and P; Au, Cu, Ag, Si and Be; and Au, Cu, Pd, Si and Be.

Provided these preferred compositions, a preferred range of alloy compositions can be expressed with the following formula:

$$(Au_{1-x}(Ag_{1-y}Pd_y)_x)_aCu_b((Si_{1-z}Be_z)_{1-v}P_v)_c,$$

where a is in the range of from about 25 to about 75, b is in the range of about 10 to about 50, and c is in the range of about 10 to about 35 in atomic percentages; preferably a is in the range of from about 39 to about 70, b is in the range of about 15 to about 45, and c is in the range of about 12 to about 30 in atomic percentages; and still most preferably a is in the range of from about 31 to about 64, b is in the range of about 22 to about 36, and c is in the range of about 12 to about 26 in atomic percentages. Furthermore, x is in the range from about 0.0 to about 0.5, y is in the range of from about 0.0 to about 1.0, z is in the range of from about 0.0 to about 0.5, and v is in the range between 0 and 0.5; and preferably, x is in the range from about 0.0 to about 0.3, y is in the range of from about 0 to about 0.9, z is in the range of from about 0.0 to about 0.3, and v is in the range between 0 and 0.5; and still more preferable x is in the range from about 0.05 to about 0.15, y is in the range of from about 0 to about 0.8, z is in the range of from about 0.0 to about 0.1, and v is in the range between 0 and 0.5.

A still more preferred range of alloy compositions for jewelry applications can be expressed with the following formula:

$$(Au_{1-x}(Ag_{1-y}Pd_y)_x)_aCu_bSi_c,$$

where a is in the range of from about 25 to about 75, b is in the range of about 10 to about 50, and c is in the range of about 12 to about 30 in atomic percentages; preferably a is in the range of from about 29 to about 70, b is in the range of about 15 to about 45, and c is in the range of about 13 to about 25 in atomic percentages; and still most preferably a is in the range of from about 31 to about 64, b is in the range of about 22 to about 36, and c is in the range of about 14 to about 22 in atomic percentages. Furthermore, x is in the range from about 0.0 to about 0.5, and y is in the range of from about 0.0 to about 1.0; and preferably, x is in the range from about 0.0 to about 0.3, and y is in the range of from about 0.0 to about 0.9, and even more preferable x is in the range from about 0.05 to about 0.15, and y is in the range of from about 0.0 to about 0.8.

EXAMPLES

The following alloy compositions are exemplary compositions, which can be cast into large bulk objects of up to 4 mm in diameter or more.

$Au_{49}Cu_{26.9}Ag_{5.5}Pd_{2.3}Si_{16.3}$
$Au_{47}Cu_{29.8}Ag_4Pd_{2.5}Si_{16.7}$
$Au_{48.2}Cu_{27}Ag_{5.5}Pd_{2.3}Si_{13}Be_4$
$Au_{47}Cu_{28.8}Ag_4Pd_{2.5}Si_{16.7}Zr_1$

The following alloy compositions are exemplary compositions, which can be cast into large bulk objects of up to 1 mm in diameter or more.

$Au_{48}Cu_{30}Ag_5Si_{17}$
$Au_{55}Cu_{30}Si_{16}P_7$
$Au_{53}Cu_{30}Si_{13}Be_7$
$Au_{61}Cu_{16.7}Ag_4Pd_{2.3}Si_{16}$
$Au_{33}Cu_{44.7}Ag_4Pd_{2.3}Si_{16}$

Finally, the invention is also directed to a method of forming a Au-based amorphous alloy as described above. In this embodiment the method would include forming an alloy having the formula as described above, and then cooling the entire alloy from above its melting temperature to a temperature below its glass transition temperature at a sufficient rate to prevent formation of a crystalline phase above a satisfactory level.

Although specific embodiments are disclosed herein, it is expected that persons skilled in the art can and will design alternative Au-based bulk solidifying amorphous alloys and methods of making such alloys that are within the scope of the following claims either literally or under the Doctrine of Equivalents.

What is claimed is:

1. A bulk-solidifying amorphous alloy comprising Au from 25 to 75 atomic percent, Cu from 13 to 45 atomic percent, and Si from 12 to less than 20 atomic percent, wherein the bulk-solidifying amorphous alloy has a minimum thickness of about 1 mm.

2. The bulk-solidifying amorphous alloy of claim 1, comprising Au from 30 to 67 atomic percent, Cu from 19 to 40 atomic percent, and Si from 14 to less than 20 atomic percent.

3. The bulk-solidifying amorphous alloy of claim 1, comprising Au from 40 to 60 atomic percent, Cu from 24 to 36 atomic percent, and Si from 16 to less than 20 atomic percent.

4. The bulk-solidifying amorphous alloy of claim 1, further comprising Ag.

5. The bulk-solidifying amorphous alloy of claim 4, wherein the atomic ratio of Ag to Au is up to 0.3.

6. The bulk-solidifying amorphous alloy of claim 1, further comprising Pd.

7. The bulk-solidifying amorphous alloy of claim 6, wherein the atomic ratio of Pd to Au is up to 0.3.

8. The bulk-solidifying amorphous alloy of claim 1, further comprising Ni.

9. The bulk-solidifying amorphous alloy of claim 8, wherein the atomic ratio of Ni to Cu is up to 0.3.

10. The bulk-solidifying amorphous alloy of claim 1, further comprising P.

11. The bulk-solidifying amorphous alloy of claim 10, wherein the atomic ratio of P to Si is up to 1.

12. The bulk-solidifying amorphous alloy of claim 1, further comprising Be.

13. The bulk-solidifying amorphous alloy of claim 12, wherein the atomic ratio of Be to the sum of Si and any P is up to 1.

14. The bulk-solidifying amorphous alloy of claim 1, further comprising one or more elements selected from a group consisting of Ge, Al, Sn, Sb, Y, and Er.

15. A bulk-solidifying amorphous alloy, wherein the bulk-solidifying amorphous alloy comprises a 14 karat, 18 karat, or 20 karat gold alloy Au from 25 to 75 atomic percent, Cu from 13 to 45 atomic percent, and Si from 12 to less than 20 atomic percent, and wherein the bulk-solidifying amorphous alloy has a minimum thickness of about 1 mm.

16. The bulk-solidifying amorphous alloy of claim 15, further comprising one or more elements selected from a group consisting of Ge, Al, Sn, Sb, Y, Zr, Hf, Ag, Pd, Ni, P, Be and Er.

17. A bulk-solidifying amorphous alloy comprising Au from 25 to 75 atomic percent, Cu from 13 to 45 atomic percent, and Si from 12 to less than 20 atomic percent, and one or more elements selected from a group consisting of Zr, Hf, Er, and Y wherein the bulk-solidifying amorphous alloy has a minimum thickness of about 1 mm.

18. The bulk-solidifying amorphous alloy of claim 17, comprising Au from 30 to 67 atomic percent, Cu from 19 to 40 atomic percent, and Si from 14 to less than 20 atomic percent.

19. The bulk-solidifying amorphous alloy of claim 17, comprising Au from 40 to 60 atomic percent, Cu from 24 to 36 atomic percent, and Si from 16 to less than 20 atomic percent.

* * * * *